US006602138B2

(12) United States Patent
Nulph

(10) Patent No.: US 6,602,138 B2
(45) **Date of Patent: *Aug. 5, 2003**

(54) SYSTEM FOR LINKING A UNIQUE IDENTIFIER TO AN INSTANT GAME TICKET

(75) Inventor: James L Nulph, Cumming, GA (US)

(73) Assignee: Scientific Games, Inc., Alpharetta, GA (US)

( * ) Notice: Subject to any disclaimer, the term of this patent is extended or adjusted under 35 U.S.C. 154(b) by 199 days.

This patent is subject to a terminal disclaimer.

(21) Appl. No.: 09/825,000

(22) Filed: Apr. 2, 2001

(65) Prior Publication Data

US 2001/0018360 A1 Aug. 30, 2001

Related U.S. Application Data

(63) Continuation-in-part of application No. 09/358,144, filed on Jul. 20, 1999, now Pat. No. 6,234,899.

(51) Int. Cl.[7] ..... A63F 9/24

(52) U.S. Cl. ..... 463/25; 463/16; 463/17; 463/18; 463/29; 463/34; 463/43; 273/148 R

(58) Field of Search ..... 463/16, 19, 25, 463/18, 17, 29; 273/139, 148 R; 379/95; 235/380

(56) References Cited

U.S. PATENT DOCUMENTS 4,191,376 A * 3/1980 Goldman et al. ..... 273/139
4,398,708 A * 8/1983 Goldman et al. ..... 270/18
5,116,049 A * 5/1992 Sludikoff et al. ..... 273/139
5,232,221 A * 8/1993 Sludikoff et al. ..... 273/139
5,249,801 A 10/1993 Jarvis ..... 273/148 R
5,327,485 A 7/1994 Leaden ..... 379/95
5,448,044 A 9/1995 Price et al. ..... 235/380
5,580,311 A 12/1996 Haste, III ..... 463/29
5,595,538 A 1/1997 Haste, III ..... 463/17
5,613,680 A 3/1997 Groves et al. ..... 273/138.2
5,951,396 A 9/1999 Tawil ..... 463/19
5,979,894 A 11/1999 Alexoff ..... 273/139

* cited by examiner

*Primary Examiner*—Jessica Harrison
*Assistant Examiner*—Yveste Cherubin
(74) *Attorney, Agent, or Firm*—Needle & Rosenberg, PC.

(57) ABSTRACT

In a method of a method of linking a unique identifier to an instant game ticket, a user is instructed to enter or provide a unique identifier. The unique identifier is received from the user via input into the identifier entry mechanism. The unique identifier is stored in a computer-readable memory. A representation of the unique identifier and at least one game result is printed on an instant win game ticket. The user is instructed not to accept the instant win game ticket unless the representation of the unique identifier printed thereon corresponds to the unique identifier that the user provided. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims. 37 C. F. R. 1.72(b).

19 Claims, 11 Drawing Sheets

SYSTEM FOR LINKING A UNIQUE IDENTIFIER TO AN INSTANT GAME TICKET

This application is a continuation-in-part of U.S. Ser. No. 09/358,144, filed Jul. 20, 1999 now U.S. Pat. No. 6,234,899, which is incorporated herein in its entirety.

BACKGROUND OF THE INVENTION

1. Field of the Invention

The present invention relates to electronic games and, more specifically, to a system for administering electronic instant win on-line games.

2. Description of the Prior Art

Instant win games, such as those sponsored by state lotteries, often come in the form of "scratch-and-play" games, in which an instant win game ticket is sold to a user and the user removes a removable cover from a play area to indicate whether or not the ticket is a "winner."

One type of instant win game ticket is an on-line instant win game, in which the user fills out a playslip so as to indicate a selection of numbers. The playslip is read via a scanner at the point of sale and a game ticket, including information as to whether or not the user won a prize, is printed and delivered to the user. The game ticket printing usually occurs shortly after the playslip is scanned and is usually part of the same transaction.

Because the game ticket includes information as to whether the game ticket is a "winner," dishonest clerks sometimes attempt to "palm" a winning game ticket and give the user a substitute game ticket that is not a winner. Although instant win games may use security systems, (e.g., security cameras aimed at the clerks) such systems are not completely reliable and the user (who has the incentive to ensure that he receives the proper ticket) is not provided with a mechanism to verify the correspondence of the game ticket to the playslip.

SUMMARY OF THE INVENTION

The disadvantages of the prior art are overcome by the present invention which, in one aspect, is a method of linking a unique identifier to an instant game ticket. A user is instructed to enter or provide a unique identifier on an identifier entry mechanism. An image of the unique identifier is received or inputted via the identifier entry mechanism. The unique identifier is stored in a computer-readable memory. A representation of the unique identifier and at least one game result is printed on an instant win game ticket. The user is instructed not to accept the instant win game ticket unless the representation of the unique identifier printed thereon corresponds to the unique identifier that the user entered on the identifier entry mechanism.

Another aspect of the invention is a method of linking a playslip to an instant win game ticket. A user is instructed to enter a playslip identifier on a first predetermined area of a playslip. The user may be instructed to mark a plurality of marks on the first predetermined area of the playslip to indicate selection of a sub-set of characters from a set of characters preprinted on the playslip (the sub-set of characters forming the playslip identifier). The playslip is read with a playslip reader. The system determines if the user included a playslip identifier on the first predetermined area of the playslip. If the user included the playslip identifier on the first predetermined area, then the playslip identifier is stored in a computer-readable memory, a representation of the playslip identifier and at least one game result is printed on an instant win game ticket, and the user is instructed not to accept the instant win game ticket unless the representation of the playslip identifier printed thereon corresponds to the playslip identifier that the user entered on the playslip. If the user did not include the playslip identifier on the first predetermined area, then the playslip is rejected from the playslip reader. The user may also be instructed that the instant win game ticket may be redeemed for a prize if at least one of the game results, which are printed as game result characters, matches at least one of the sub-set of characters, selected by the user, that form the playslip identifier.

Another aspect of the invention is an apparatus for generating instant game tickets. The apparatus includes a scanner that is capable of reading information from a playslip, a printer that is capable of printing an instant game ticket, and a computer. The computer is programmed to instruct the scanner to read the playslip and read a playslip identifier on the playslip. If a playslip identifier is detected on the playslip, then the computer instructs the printer to print an instant win game ticket that includes at least one game result and the playslip identifier. If a playslip identifier is not detected on the playslip, then the computer rejects the playslip.

In an alternative embodiment, the apparatus for generating instant game tickets includes a unique identifier entry mechanism, a printer that is capable of printing an instant game ticket, and a computer. The computer is programmed to detect the unique identifier entered on the unique identifier entry mechanism. If a unique identifier is detected, then the computer instructs the printer to print an instant win game ticket that includes at least one game result and the unique identifier. If a unique identifier is not detected or is in an improper format, then the computer will not print the instant win game ticket.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
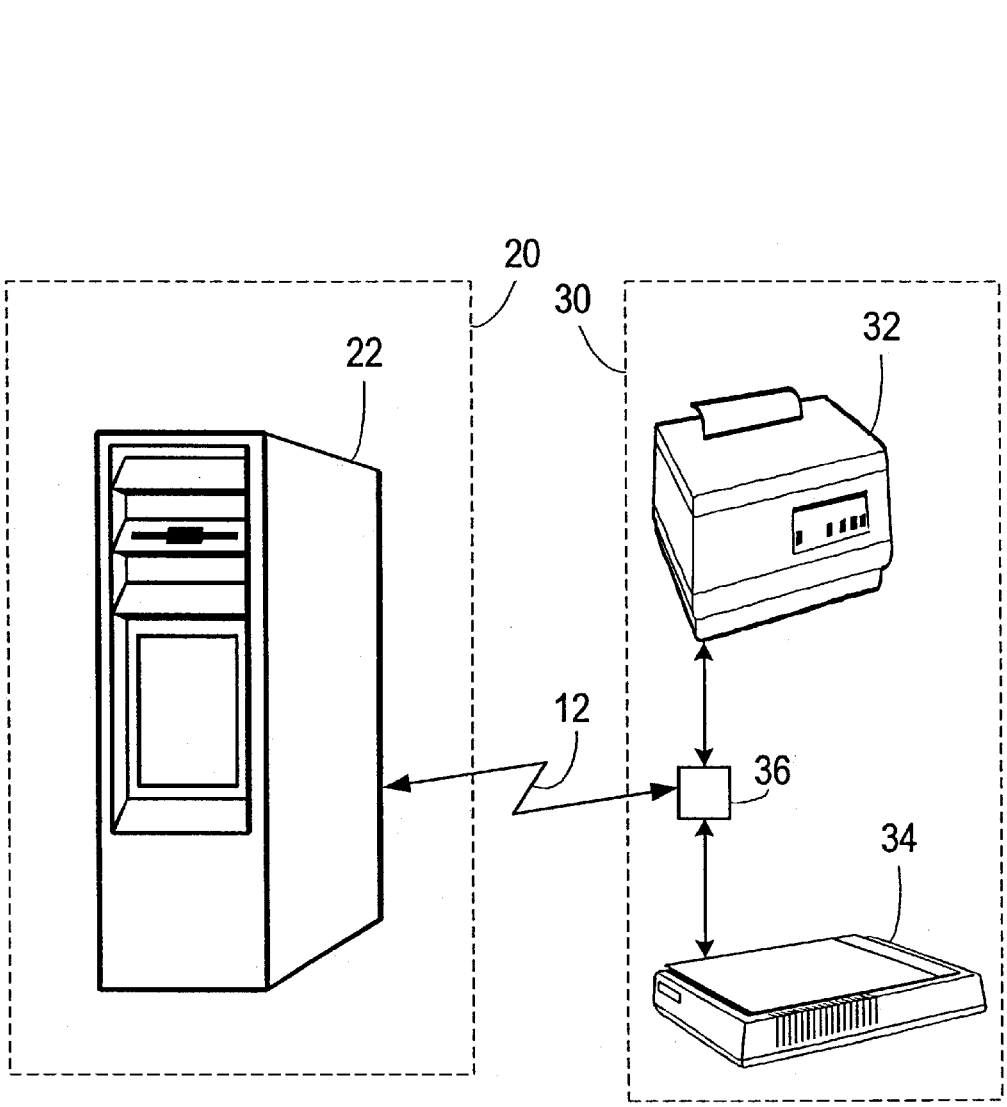
FIG. 1 is a schematic diagram showing the entities and hardware in accordance with one embodiment of the invention.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural referents, the meaning of "in" includes "in" and "on."

The figures referred to herein include examples of embodiments of the invention that contain depictions that may resemble trademarks or trade names. It is the intention of the inventor that such depictions represent only the idea of such an identifier being used in association with the embodiment, and that such depictions do not resemble any actual trademarks or trade names. Any resemblance of any of the depictions in the figures to any actual trademark or trade name is completely unintentional and merely coincidental. Therefore, none of the depictions in the figures should be interpreted as showing any affiliation with any actual source of goods or services.

As shown in FIG. 1, the entities involved in executing the method of the invention include a controlling authority 20, such as a lottery administration company, and a local game administering entity 30, such as a lottery ticket retailer. The controlling authority 20 would have control over a central game server 22, which would communicate with an identifier entry mechanism 34 a game ticket printer 32, both of which would be located at the site of the local game administering entity 30. The identifier entry mechanism 34 could comprise a digital capture pad (such as a digital signature capture pad, of the type used in association with many cash registers), a playslip scanner, in the case of embodiments of the invention that require the user to fill out a playslip, a symbol pad, such as a keypad, a keyboard and the like, or a microphone. The symbol pad and the microphone may be used in the case of embodiments of the invention that require the user or a third party, such as a mechanical operator, to enter the unique identifier into the identifier entry mechanism 34. The server 22 would typically be a computer system, including a computer-readable memory. Both the game ticket printer 32 and the identifier entry mechanism 34 could be embedded into a game administration device 36 (or they could be stand alone devices) that includes a microprocessor, and some of the computational functions of the central game server 22 could be distributed to the local game administering device 36. The server 22 could communicate with the game administering device 36 via one of many types of electronic communications channels 12 (for example, a dedicated line, a global computer network, or a telephone line). As one will appreciate, if a microphone is used as the identifier entry mechanism 34, then the server 22 may include voice recognition software so that the server 22 can recognize and translate speech.

Figure 2:
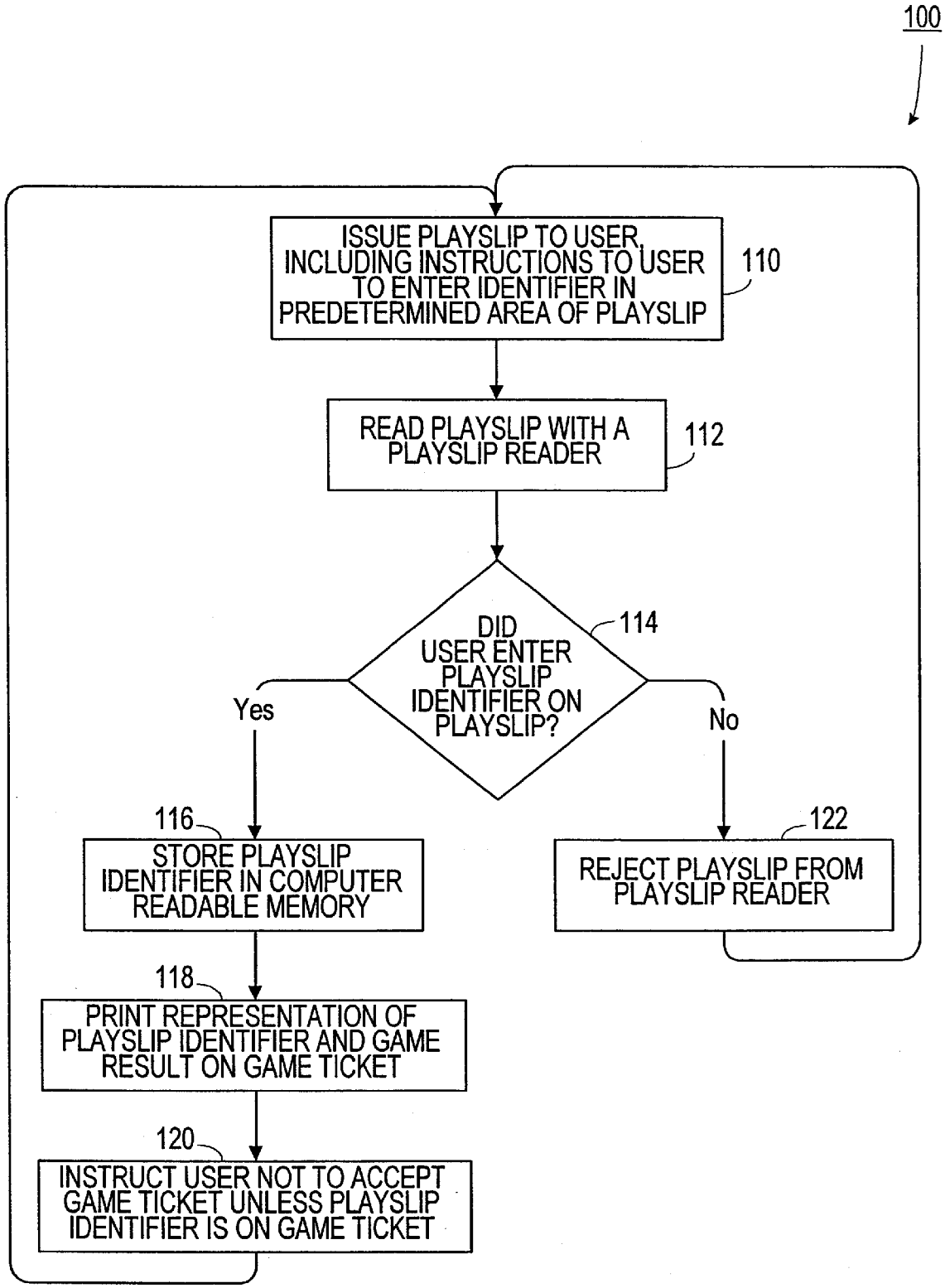
FIG. 2 is a flowchart demonstrating one method of the invention.

As shown in FIG. 2, the method 100 employed in one embodiment of the invention involves first issuing a playslip 110 to a user, this would typically be done by the local game administering entity 30. Typically, the playslips are preprinted. The user is instructed to enter a playslip identifier on a preassigned area of the playslip. Such an identifier could, for example, take the form of the user's initials or a selection of a group of user-selected characters from a set of characters provided on the playslip. Typically, the instruction to the user comes in the form of instructions printed on the playslip, but could also come from informational brochures and by word of mouth from personnel at the local game administering entity 30.

Once the user has filled out the playslip, the playslip is read 112 into the playslip scanner 34 and the server performs a test 114 to determine if the user entered a playslip identifier. If the answer to test 114 is "no," then the playslip is rejected 122 from the system and the user is instructed that the playslip will not be accepted unless it is properly filled out.

If the answer to test 114 is "yes," then the playslip identifier is stored 116 in a computer readable memory. Such storage could take the form of storing a scanned image of initials entered, storing a record of positions on the playslip that have been marked by the user or transforming initials into corresponding text characters and storing the text characters.

Once a playslip has been properly read, the game ticket printer 32 is instructed 118 to print on a game ticket a representation of the playslip identifier and at least one game result. The printed playslip identifier could take the form of a printed image of the originally entered playslip identifier or a plurality of characters corresponding to the original playslip identifier, depending on the type of game ticket printer employed.

The printed game ticket is then issued to the user and the user is instructed 120 not to accept the game ticket unless the playslip identifier entered by the user is properly printed on the ticket. This instruction 120 could be printed on the playslip or the game ticket, or both.

Figure 3A:
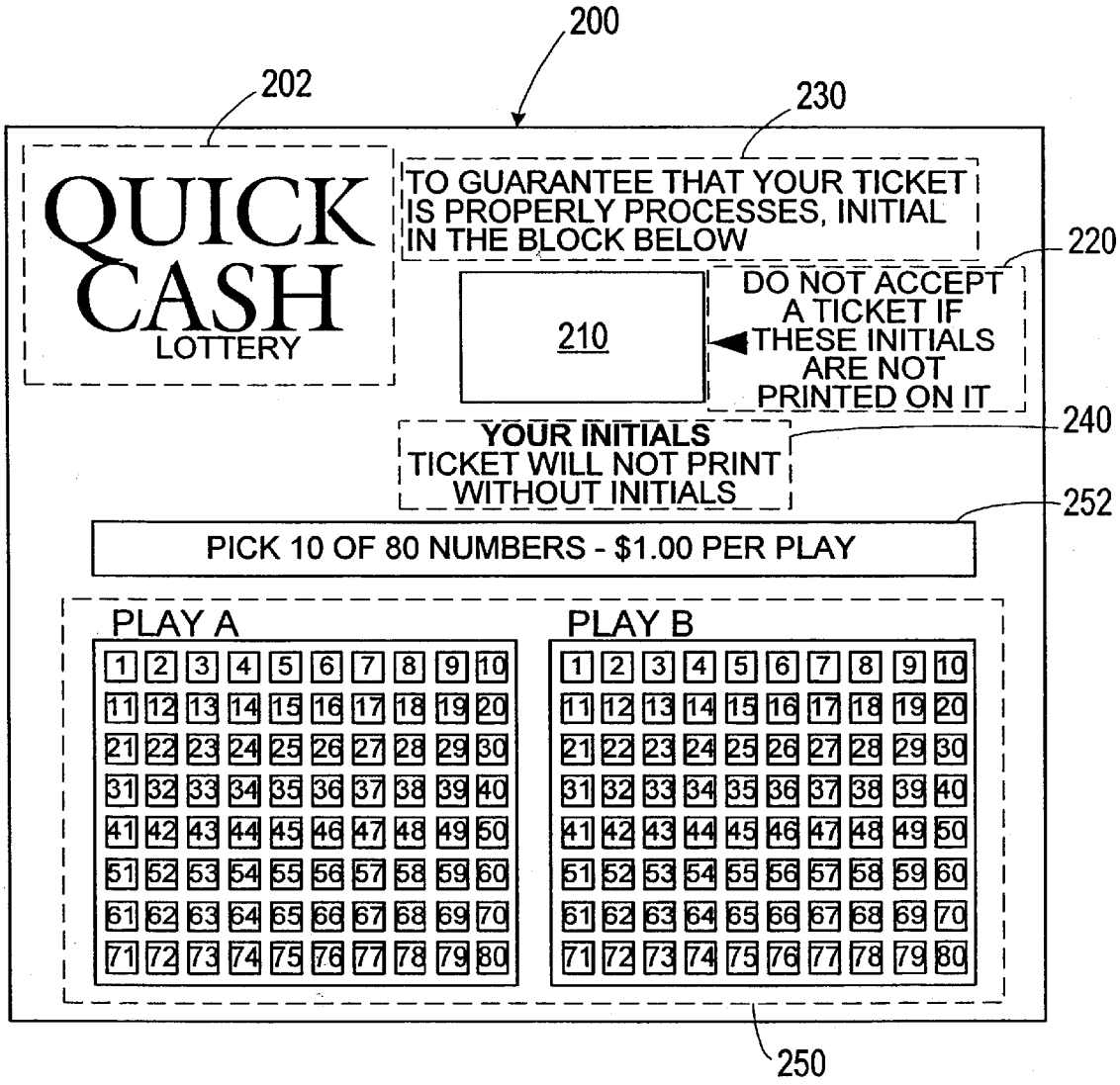
FIG. 3A is a schematic view of an unused playslip in accordance with a first aspect of the invention.
Figure 3B:
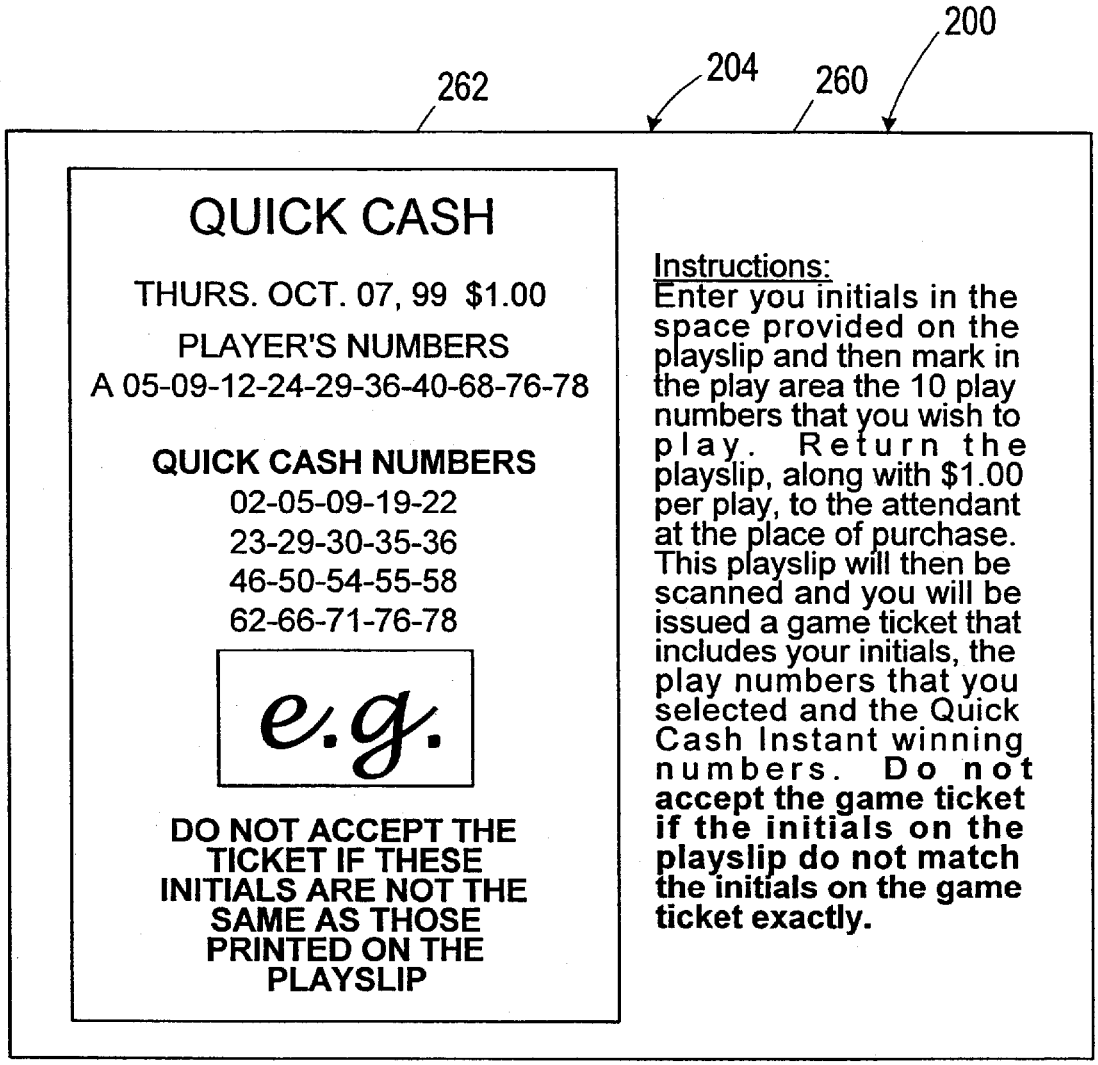
FIG. 3B is a schematic view of the backside of the playslip shown in FIG. 2A.
Figure 3C:
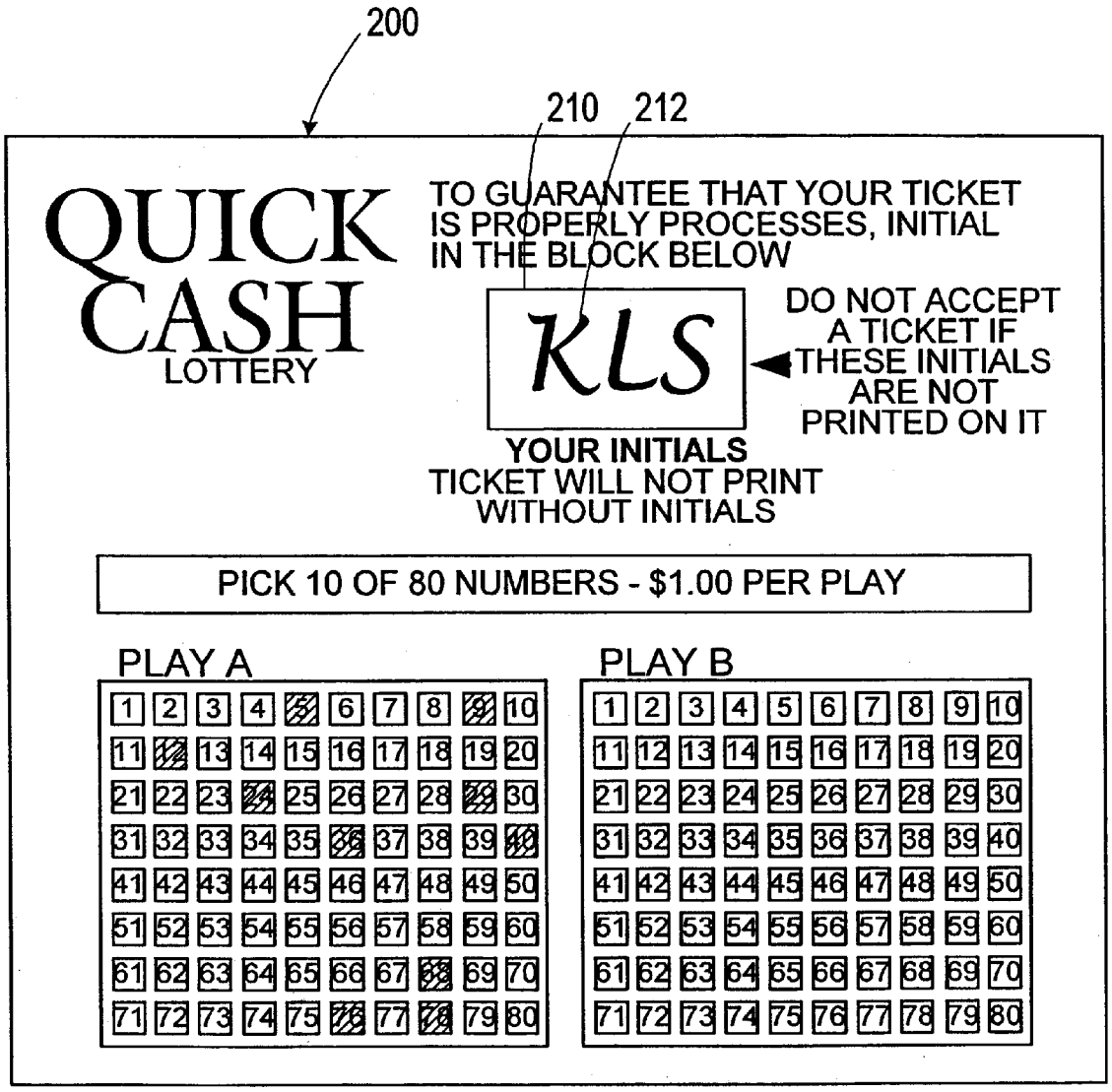
FIG. 3C is a schematic view of the playslip shown in FIG. 2A, after having been filled in by a user.

As shown in FIGS. 3A–3C, a typical playslip 200 would include a game identifier 202 and an area 210 for the user to enter a playslip identifier. The playslip 200 includes a first set of instructions 230 printed thereon that tells the user to enter the user's initials in the area 210 provided for the playslip identifier. (While the embodiment shown in FIGS. 3A–3C use the user's initials as the playslip identifier, other types of playslip identifier could be used without departing from the scope of the invention.) A second set of instructions 220 instruct the user not to accept a game ticket unless the playslip identifier appearing in the playslip identifier area 210 also appears on the subsequently printed game ticket. A third set of instructions 240 tells the user that the game ticket will not be printed unless the playslip identifier area 210 is properly filled in. As shown in FIG. 3C, a playslip 200 that is properly filled out would include the playslip identifier 212 (such as the user's initials) in the playslip identifier area 210.

A play number entry area 250 may also be provided for games that require the user to enter play information (for example, select a subset of numbers from an array of numbers). Instructions 252 on how to play the game may also be provided.

As shown in FIG. 3B, the back side 204 of the playslip 200 may be provided with a complete set of instructions 260 on how to fill out the playslip 200 and how to play the game. An example 262 of a typical game ticket could also be printed on the back side 204.

Figure 4:
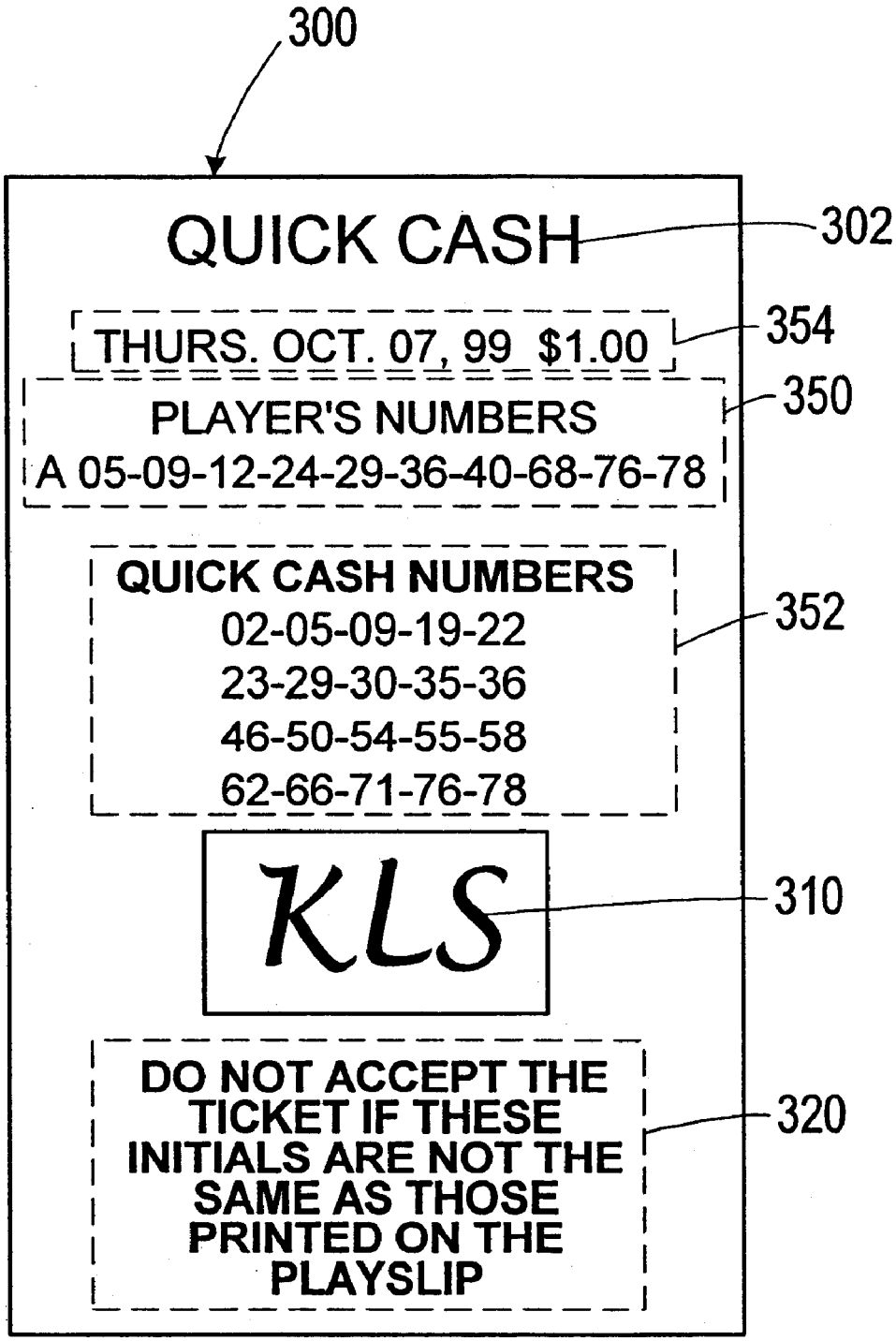
FIG. 4 is a schematic view of an instant win game ticket corresponding to the playslip shown in FIG. 2C.

A game ticket 300, which is printed after the user has filled out the playslip 200 and the playslip 200 has been scanned into the system, is shown in FIG. 4. Typically, the game ticket 300 would include a game identifier 302, an indication 354 of the date that the game was played, an indication 350 of user-input play numbers (entered in the play number entry area 250 shown in FIG. 3A, if such play numbers are used in the game), an indication 352 of the game results (such as winning numbers), an area that includes a printed representation 310 of the playslip identifier (as entered by the user on the playslip 200) and a set of instructions 320 instructing the user not to accept the game ticket 300 unless the representation 310 of the playslip identifier on the game ticket 300 is the same as the playslip identifier 212 that the user entered on the playslip 200.

In an embodiment where the printer 32 is capable of printing an image of user-entered initials, the representation 310 of the playslip identifier should look exactly like the playslip identifier 212 entered on the playslip 200. If the printer 32 is not capable of printing a scanned image (e.g., if the printer 32 is an impact printer), then either the game administering device 36 or the server 22 would transform the scanned playslip identifier 212 into a machine character equivalent (e.g., into corresponding ASCII characters) and the representation 310 of the playslip identifier would be a print-out of the characters.

Figure 5:
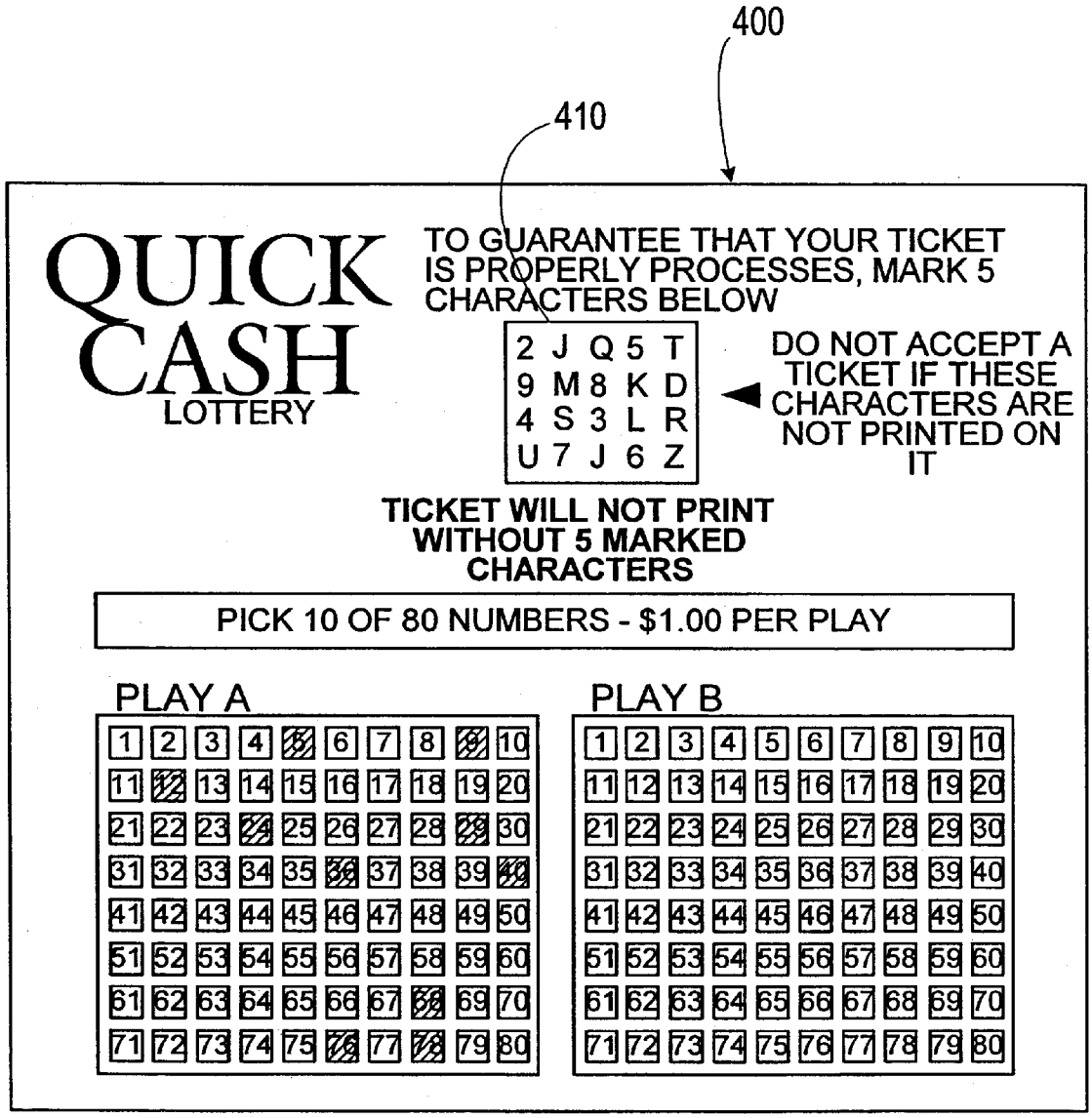
FIG. 5 is a schematic view of an unused playslip in accordance with a second aspect of the invention.
Figure 6:
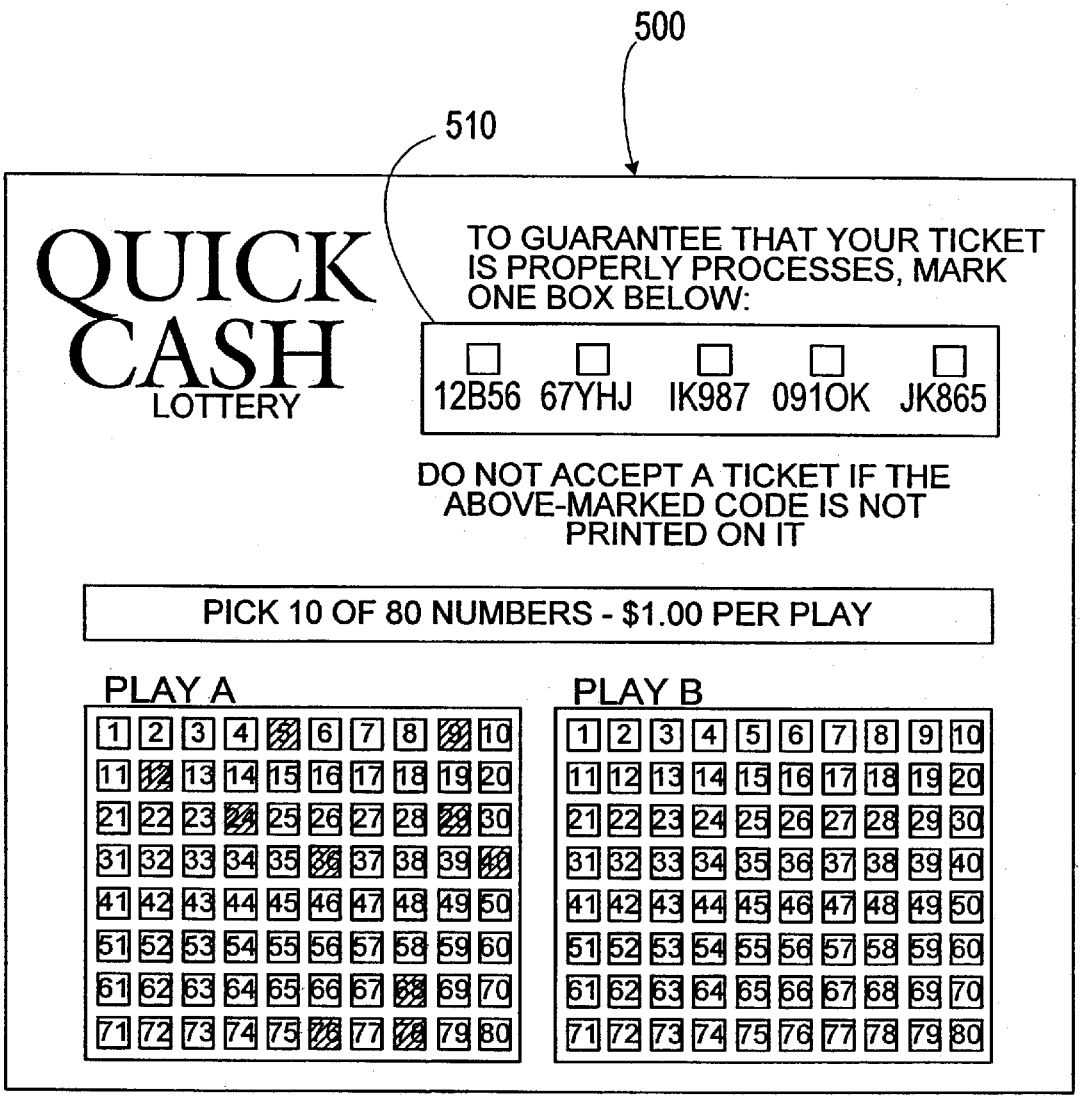
FIG. 6 is a schematic view of an unused playslip in accordance with a third aspect of the invention.

A shown in FIG. 5, in an alternate embodiment, the playslip 400 could be preprinted with a plurality of characters 410 and the user could be instructed to mark a subset of the characters 410, with the marked subset serving as the playslip identifier. As shown in FIG. 6, the playslip 500 could be printed with a plurality of character strings 510, one of which the user would mark as the playslip identifier. The embodiments of FIGS. 5 and 6 offer the advantage of facilitating easy machine reading of the playslip identifier and relatively lower memory usage than the embodiment of FIGS. 3A–3C. However, they might be more susceptible to forgery than the embodiment of FIGS. 3A–3C. Selection of the embodiment would depend on the hardware available and the level of security that is required. For example, games with a relatively high pay out might require a higher level of security and, thus, may be subject to more stringent playslip identifier verification requirements. It may be desirable in some applications to use more than one type of playslip identifier. Some applications might require the user to both enter initials and select a set of characters. It is intended that such system fall within the scope of the invention.

Figure 7:
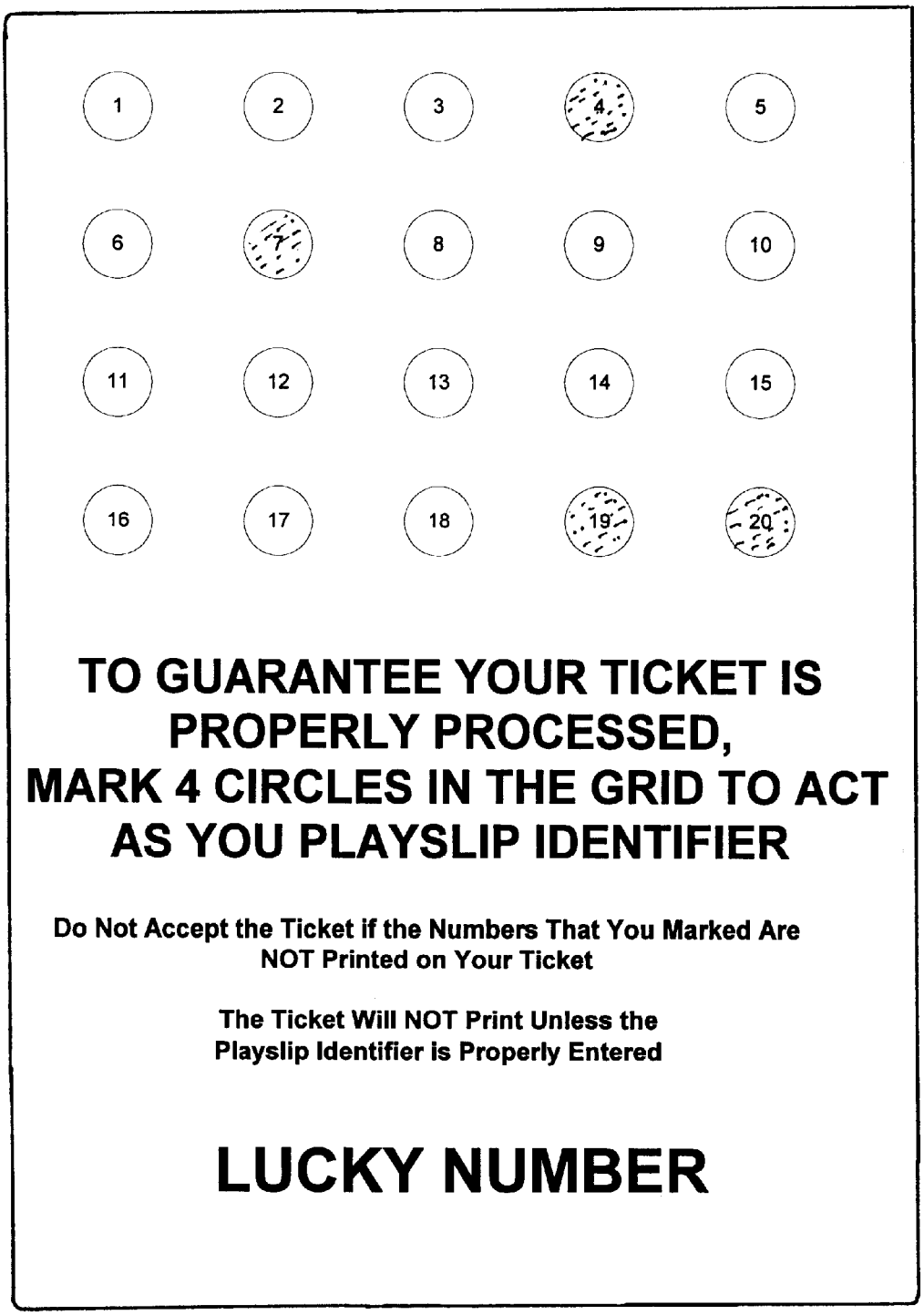
FIG. 7 is a schematic view of an unused playslip in accordance with a fourth aspect of the invention.
Figure 8:
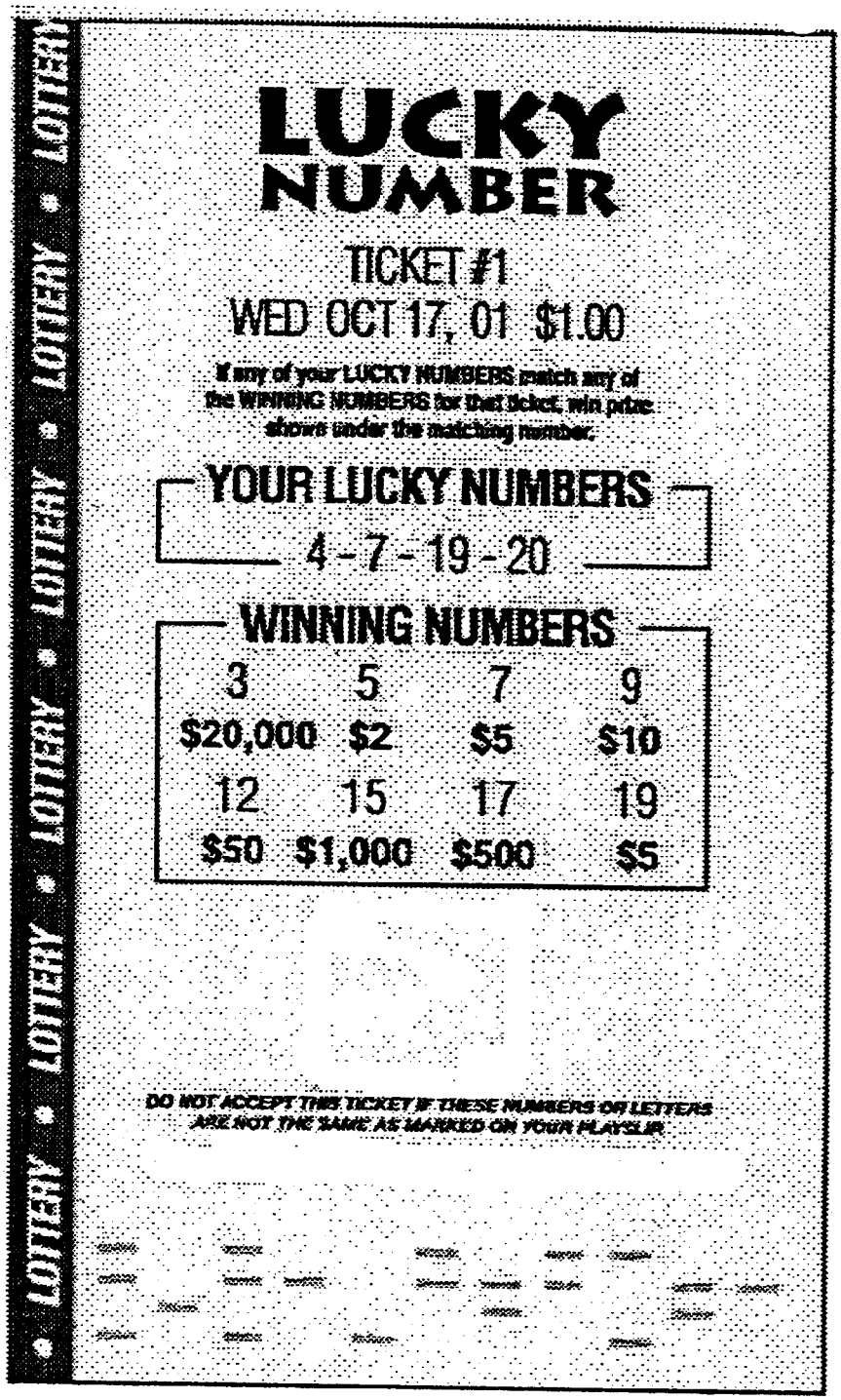
FIG. 8 is a schematic view of an instant win game ticket having a user-selected or provided unique identifier, corresponding to the playslip shown in FIG. 7, that forms a part of the ticket play method.
Figure 9:
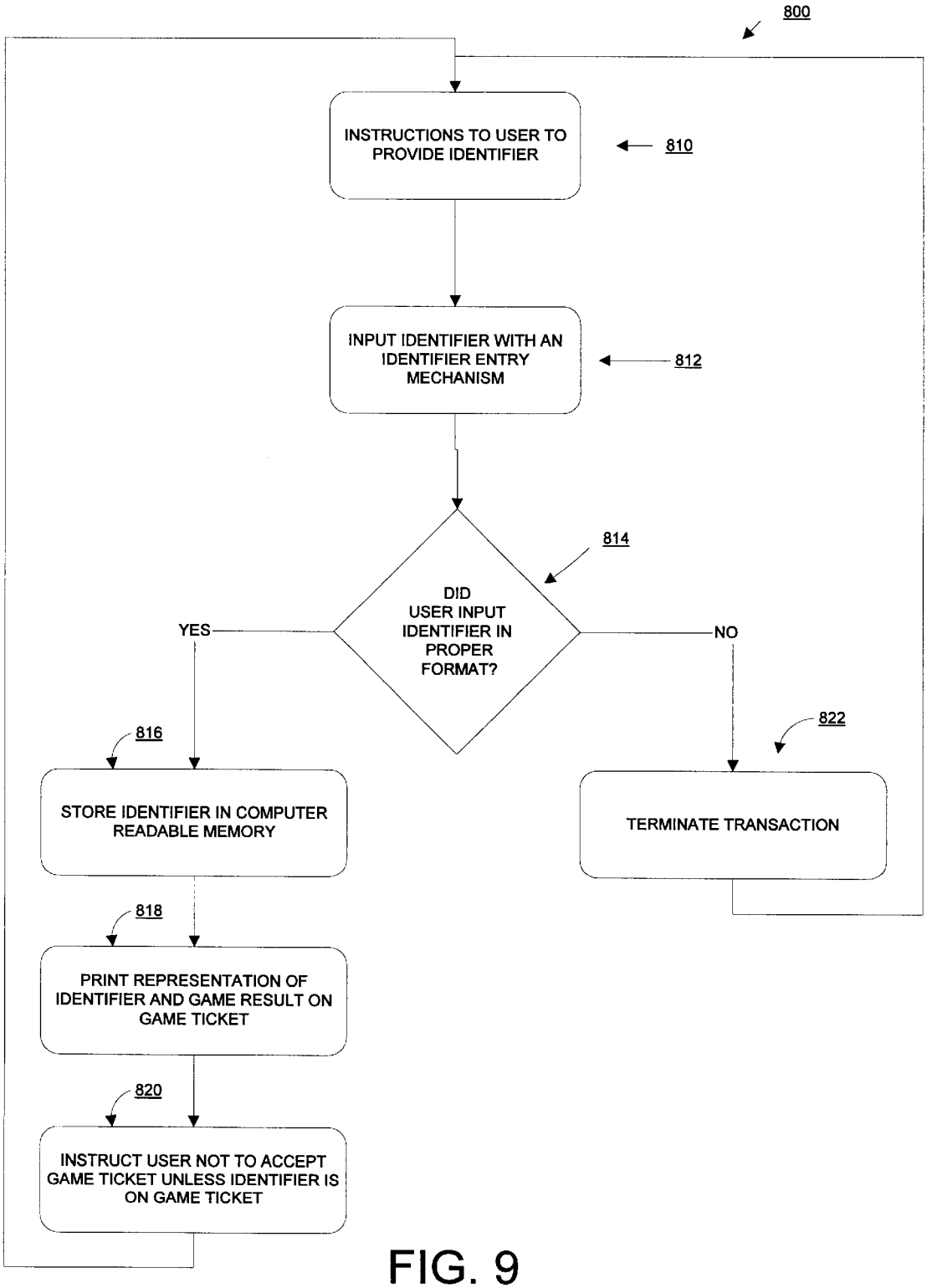
FIG. 9 is a flowchart demonstrating a second method of the invention.

The selection of a playslip identifier by the user may also be used in combination with a part of a ticket play method. Referring to FIGS. 7 and 8, the user is instructed to mark, for example, a sub-set of the plurality of characters 700 that are preprinted on a playslip. Alternatively, the user may be instructed to select a character string that is pre-printed on the playslip. The marked characters serve as the playslip identifier 710. The instant win game ticket will include the playslip identifier 710 and at least one game result 720. As one will appreciate, each of the printed game result(s) 720 on the printed instant win game ticket are printed in the form of a game result character 730. The printed game result character 730 forms a part of the ticket play method in that the user may be instructed that the instant win game ticket may be redeemed for a prize if at least one of the printed game result characters 730 match at least one of the characters that the user had selected as the playslip identifier 710. For example, if at least one of the characters of the sub-set of characters that forms the user-selected playslip identifier 710 match at least one of the game result characters 730, the ticket may be redeemed for the prize. In an example of the game play, if the lucky numbers "4," "7," "19," and "20" are selected by the user on the playslip shown in FIG. 7 to serve as the playslip identifier 710, the printed instant win game ticket will include the lucky numbers, i.e., the playslip identifier 710, and at least one game result. As shown in an exemplified instant win game ticket shown in FIG. 8, the two "lucky" numbers 7 and 19, of the four user-selected numbers forming the playslip identifier 710, match two of the game result characters 730 and are thus both instant prize winners (of $5 each).

As shown in FIG. 8, the method 800 employed in an alternative embodiment of the invention involves first instructing the user to provide a unique identifier 810. The unique identifier is input into the server 812 via an identifier entry mechanism. The user may entry the unique identifier into the identifier entry mechanism 34 without aid of a third party. However, the instructions may also direct the user to provide the unique identifier to a third party, such as a machine operator of the local game administering entity 30, so that the third party can input the unique identifier provided by the user on the identifier entry mechanism 34. The instructions may direct the user to voice the unique identifier to the third party for entry or provide a representation of the unique identifier, such as, for example, a written unique identifier, to the third party for entry.

After the unique identifier is input, the server 22 detects a unique identifier entered on the unique entry mechanism 34 and the server performs a test 814 to determine if the unique identifier has been entered in a proper format. If the answer to test 814 is "no," then the transaction is terminated 822 and the user is instructed that the unique identifier provided was not in proper format and the instant win game ticket cannot be printed until a new unique identifier, in proper format, is received.

If the answer to the test 814 is "yes," then the unique identifier is stored 816 in a computer readable memory. Further, the game ticket printer 32 is instructed 818 to print on a game ticket a representation of the unique identifier and a least one game result. Typically, the printed unique identifier would take the form of a plurality of characters corresponding to the originally provided unique identifier.

The printed instant win game ticket is then issued to the user and the user is instructed 820 not to accept the game ticket unless the unique identifier entered and/or provided by the user is properly printed on the ticket. This instruction may be included with the instructions regarding game play or could be printed on the ticket. As one will appreciate, typically the instructions to the user comes in the form of instructions printed on signage on or about the identifier entry mechanism 34, but could also come from informational brochures and by word of mouth from third parties, such as personnel or the machine operator, at the local game administering entity 30.

The above described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. A method of linking a unique identifier to an instant game ticket, comprising:

a. instructing a user to provide a unique identifier;

b. inputting the unique identifier via an identifier entry mechanism;

c. storing the unique identifier in a computer-readable memory;

d. printing a representation of the unique identifier and at least one game result on an instant win game ticket; and e. instructing the user not to accept the instant win game ticket unless the representation of the unique identifier printed thereon corresponds to the unique identifier that the user provided.

2. The method of claim 1, wherein instructing the user to provide a unique identifier further comprises instructing the user to voice the unique identifier to a machine operator.

3. The method of claim 2, wherein inputting the unique identifier further comprises having a machine operator input the unique identifier provided by the user on the identifier entry mechanism.

4. The method of claim 1, wherein inputting the unique identifier further comprises the machine operator entering the unique identifier on a symbol pad.

5. The method of claim 1, wherein the identifier entry mechanism has a microphone, and wherein inputting the unique identifier further comprises speaking the unique identifier into the microphone.

6. A method of linking a playslip to an instant win game ticket, comprising:

a. instructing a user to enter a playslip identifier on a playslip by making a plurality of marks on a first predetermined area of the playslip that indicate selection of a sub-set of characters from a set of characters, the sub-set of characters selected forming the playslip identifier;

b. reading the playslip with a playslip reader;

c. determining if the user included the playslip identifier on the first predetermined area of the playslip; and d. if the user included the playslip identifier on the first predetermined area, then performing the following steps:

i. storing the playslip identifier in a computer-readable memory;

ii. printing a representation of the playslip identifier and at least one game result character on an instant win game ticket; and iii. instructing the user not to accept the instant win game ticket unless the representation of the playslip identifier printed thereon corresponds to the playslip identifier that the user entered on the playslip.

7. The method of claim 6, further comprising rejecting the playslip from the playslip reader if the user did not include the playslip identifier on the first predetermined area.

8. The method of claim 6, further comprising instructing the user that the playslip may be redeemed for a prize if at least one of the printed game result characters match at least one of the sub-set of characters, selected by the user, that form the playslip identifier.

9. An apparatus for generating instant game tickets, comprising:

a. an unique identifier entry mechanism;

b. a printer that is capable of printing an instant game ticket; and c. a computer programmed to:

i. detect a unique identifier entered on the unique identifier entry mechanism; and ii. if a unique identifier is detected, then instruct the printer to print an instant win game ticket that includes at least one game result and the unique identifier.

10. The apparatus of claim 9, wherein the unique identifier entry mechanism is a symbol pad.

11. The apparatus of claim 9, wherein the unique identifier entry mechanism is a microphone, and wherein the computer is programmed to recognize and translate speech.

12. An apparatus for generating instant game tickets, comprising:

a. a scanner that is capable of reading information from a playslip having a set of characters preprinted thereon;

b. a printer that is capable of printing an instant game ticket; and c. a computer programmed to:

i. instruct the scanner to read the playslip;

ii. read a playslip identifier; and iii. if a playslip identifier is detected, then instruct the printer to print an instant win game ticket that includes at least one game result and the playslip identifier, otherwise, reject the playslip, wherein the playslip identifier is selected from a sub-set of characters from the set of characters on the playslip.

13. A device for linking a playslip to an instant game ticket, comprising:

a. means for instructing a user to select a playslip identifier from a set of characters preprinted on the playslip;

b. means for reading the playslip identifier with a playslip reader;

c. means for storing the playslip identifier in a computer-readable memory;

d. means for printing a representation of the playslip identifier and at least one game result character on an instant game ticket;

e. means for rejecting the playslip if it does not include a user-selected playslip identifier; and f. means for instructing the user not to accept the instant game ticket unless the representation of the playslip identifier printed thereon corresponds to the playslip identifier that the user selected on the playslip.

14. The device of claim 13, wherein means for instructing the user includes instructing in the user to select a sub-set of the preprinted set of characters to select the playslip identifier.

15. The device of claim 13, wherein the set of characters are preprinted in a plurality of identification character strings, each identification character string forming a unique identifier, and wherein the user selects one identification character string to act as the playslip identifier.

16. The device of claim 13, further comprising means for instructing the user that the playslip may be redeemed for a prize if at least one of the printed game result characters match at least one of the characters, selected by the user, that form the playslip identifier.

17. A device for linking a unique identifier to an instant game ticket, comprising:

a. means for instructing a user to provide a unique identifier;

b. means for inputting the unique identifier via an identifier entry mechanism;

c. means for storing the unique identifier in a computer-readable memory;

d. means for printing a representation of the unique identifier and at least one game result on an instant game ticket; and e. means for instructing the user not to accept the instant game ticket unless the representation of the unique identifier printed thereon corresponds to the unique identifier that the user provided.

18. The device of claim 17, wherein the identifier entry mechanism has a symbol pad.

19. The device of claim 17, wherein the identifier entry mechanism has a microphone, and the means for receiving includes voice recognition software.

* * * * *